US008509459B1

(12) United States Patent
Isvan

(10) Patent No.: US 8,509,459 B1
(45) Date of Patent: Aug. 13, 2013

(54) NOISE CANCELLING MICROPHONE WITH REDUCED ACOUSTIC LEAKAGE

(75) Inventor: Osman K. Isvan, Aptos, CA (US)

(73) Assignee: Plantronics, Inc., Santa Cruz, CA (US)

( * ) Notice: Subject to any disclaimer, the term of this patent is extended or adjusted under 35 U.S.C. 154(b) by 1664 days.

(21) Appl. No.: 11/317,358

(22) Filed: Dec. 23, 2005

(51) Int. Cl.
*H04R 3/00* (2006.01)

(52) U.S. Cl.
USPC ..... 381/113; 381/111; 381/347; 381/348; 381/357

(58) Field of Classification Search
USPC ..... 381/122, 111, 355–358, 365, 91–92, 381/113, 347–348, 362
See application file for complete search history.

(56) References Cited

PUBLICATIONS

Applicant's admitted prior art. pp. 1-5, Figures 1 and 2. No date provided.*
Applicant's admitted prior art, Figures 1-3; p. 2, paragraph 2-p. 5, paragraph 0012. No date avaiable.*

* cited by examiner

*Primary Examiner* — Disler Paul
(74) *Attorney, Agent, or Firm* — Chuang Intellectual Property Law

(57) ABSTRACT

Systems and methods for a noise canceling microphone and microphone system are disclosed. The system generally includes a housing with a printed circuit board forming a surface of the housing. Electrical terminals are located on an exterior side of the printed circuit board. A diaphragm is disposed within the housing. A first port in the housing remote from the printed circuit board provides access to one face of the diaphragm first face and a second port disposed in the housing remote from the printed circuit board provides access to a second face of the diaphragm.

14 Claims, 10 Drawing Sheets

NOISE CANCELLING MICROPHONE WITH REDUCED ACOUSTIC LEAKAGE

BACKGROUND OF THE INVENTION

Electret Condenser Microphones (ECM) used in communications headsets are often housed in elastomeric components called boots. The primary function of a microphone boot is to create an acoustic seal with the microphone so that only the sound entering from the acoustic port(s) located on the external surfaces of the headset or microphone boom can reach the microphone diaphragm. All other acoustic paths between the speaker and the microphone diaphragm impair communications on delayed lines. A secondary function of a microphone boot is to act as a resonator for frequency response shaping.

Microphone assemblies used in telephonic devices and headsets include a microphone transducer, sound port(s), and a housing containing the signal processing circuitry. This invention relates to microphones with two sound ports (i.e., gradient microphones, also known as noise canceling microphones). Referring to FIG. 1, a prior art noise canceling microphone assembly 100 is illustrated.

The microphone assembly includes a housing can 101, a printed circuit board (PCB) 110, and a microphone transducer. The microphone transducer is typically an electret type microphone comprised of a charged metallized diaphragm 104 forming one plate of a capacitor and a backplate 106 forming the other plate with a dielectric disposed in between. The charge is typically provided by an electret material disposed on the surface of the back plate. The dielectric consists of an air gap 102 between diaphragm 104 and backplate 106. Sound impinging on the diaphragm causes the diaphragm to vibrate. Diaphragm vibration varies the capacitance and produces a voltage signal proportional to the pressure difference across the diaphragm. Such electret microphones typically use an integrated circuit (IC) 108 having a junction field effect transistor (JFET) disposed on printed circuit board (PCB) to amplify the output of the electret microphone and transform the very high impedance of the small capacitor formed by the electret microphone to a more usable lower value without undue capacitive divider losses. The microphone backplate 106 is coupled to the gate terminal of the junction field effect transistor. Prior art noise canceling microphone assembly 100 has a primary port 112 (also referred to herein as a front port) in a front surface and a cancellation port 114 in the back surface of the housing in the PCB 110. The noise cancellation port 114 extends from a first side of PCB 110 to a second side of PCB 110.

In one example of a prior art device, the housing can 101 has an open end 103 with PCB 110 forming the face of the open end 103. Face 105 of PCB 110 with terminals 116, 118 forms the external surface of open end 103. Noise cancellation port 114 is used to cancel out undesired ambient or background noise which arrives from a different angle and originates much farther from the microphone than the voice of the user. Sound waves that arrive at opposite sides of the diaphragm in equal phase and amplitude do not induce diaphragm vibration. This condition is referred to as acoustic cancellation. In headset applications, the microphone/boot assembly is oriented such that sound waves emanating from the desired sound source (user's mouth) reach the front face of the diaphragm earlier and with greater amplitude than they reach the rear face of the diaphragm. Thus, acoustic cancellation is minimized. In contrast, sound waves emanating from sound sources that are located far away and in other directions arrive at opposite sides of the diaphragm in more nearly the same phase and amplitude, resulting in more acoustic cancellation. Therefore, the microphone is less sensitive to ambient noise than to the user's voice. This phenomenon is referred to as "noise cancellation".

FIG. 2 illustrates a perspective view of the prior art noise canceling microphone assembly 100. The microphone assembly 100 has a primary port 112 and one or more cancellation ports 114 for receiving acoustic input signals 170, 172, and electrical terminals 116, 118 for delivering an electrical signal representative of the difference in the acoustic input signals 170, 172. The microphone assembly 100 is commercially available and will not be discussed in detail herein except to note that it is a pressure-gradient microphone, where only the pressure difference between the two acoustic input signals 170, 172 is transduced into an electrical signal by an acoustically sensitive membrane (not shown).

Referring again to FIG. 1, microphone assembly 100 has electrical terminals 116 and 118 on the surface of PCB 110 to which microphone electrical lead 156 and electrical lead 158 are attached. The use of PCB 110 to which microphone electrical lead 156 and electrical lead 158 are coupled provides a lower cost design. Other microphone designs, such as certain specialty hearing aid designs do not utilize a PCB with electrical leads attached and are therefore more expensive. Electrical terminal 116 is coupled to backplate 106 via a connector 120, and electrical terminal 118 is coupled to the diaphragm 104 via metal case 101 and washer 111.

A first end of a resistor 117 is coupled to terminal 118. A filter capacitor 119 is coupled between terminal 118 and output terminal 121. The second end of resistor 117 is coupled to a bias voltage V+ 123. Terminal 116 is coupled to output terminal 125. Filter capacitor 119 is used to filter out the DC component V+ and radiofrequency interference (RFI) in the output of the microphone signal.

FIG. 3 illustrates prior art microphone assembly 100 in use with a headset boom 150. Referring to FIG. 3, in conventional prior art noise canceling headsets, primary port 112 and cancellation port 114 are acoustically connected with corresponding headset ports 113, 115 via two microphone boots, a front boot 152 and a rear boot 154. Front boot 152 and rear boot 154 may contain front and rear acoustic cavities adjacent to the corresponding surfaces of the microphone. Inadequate acoustic seal between the boots and microphone, referred to as acoustic leakage, impairs the noise cancellation ability of the headset. Acoustic leakage also reduces the echo path loss (measure of isolation between the received and transmitted signals in a communication terminal). With inadequate echo path loss in a headset or handset, the far end talker hears an echo of his own voice in delayed lines.

PCB 110 forms the back surface of a conventional microphone assembly 100 and contains the electrical terminals 116 and 118 as well as cancellation port 114. Hence, with conventional headset design and manufacture, adequate acoustic seal must be created around the microphone lead wires 156 and 158 as they pass through the rear boot 154. Maintaining adequate seal between the two boots and around microphone wires has always been a challenge.

A compression pad 160 maintains a force between the front boot 152 and rear boot 154 and the microphone assembly 100 so that an adequate acoustic seal can be maintained between their mating surfaces. This compressive force has assembly variations because its magnitude depends on the tolerance stack that involves many parts including the external shells of the boom.

Some prior art microphones utilize pin type connectors rather than solder tabs so that they may be mounted directly on a PCB in the headset or other communication device, such as a mobile phone. In some cases this design approach has compelling advantages. However, if a noise canceling microphone is used, the headset PCB must have an opening to the rear port of the microphone to provide access to the microphone diaphragm. This requirement increases the challenge of maintaining an adequate acoustic seal in the rear cavity. Assembly tolerances are greater, and the microphone and the rear boot must now both be sealed to the headset PCB instead of only to each other. Furthermore, the headset PCB may not have sufficient room for an opening if it is populated with circuit components. In this case, a noise canceling microphone cannot be used.

One solution to the acoustic leakage problem in the prior art is a headset boom design which does not use a microphone boot. In this design the microphone is adhered to the front acoustic cavity using a gap-filling adhesive, or sealed by a gasket. In bootless designs, the microphone wires must still be acoustically sealed as they pass through an elastomeric component called an isolation plug, which forms a boundary of the rear cavity. Isolation plugs must seal not only the wires but also the inside surface of the boom. This has proven difficult to achieve consistently in production. In addition, the volume of the rear cavity changes with the variations in the precise location of the isolation plug inside the boom shaft, resulting in variations in frequency response and noise cancellation performance. Pulling the microphone wires through the isolation plug during assembly is a difficult and time consuming process. In some prior-art headset designs, in addition to microphone electrical leads, LED wires must also pass through microphone boots or isolation plugs.

Despite these previous solutions, achieving adequate acoustic seal between the acoustic components of noise canceling headsets continues to present design and manufacturing challenges. Accordingly, there has been a need for improvements in noise canceling microphones.

BRIEF DESCRIPTION OF THE DRAWINGS

The present invention will be readily understood by the following detailed description in conjunction with the accompanying drawings, wherein like reference numerals designate like structural elements.

DESCRIPTION OF SPECIFIC EMBODIMENTS

Figure 1:
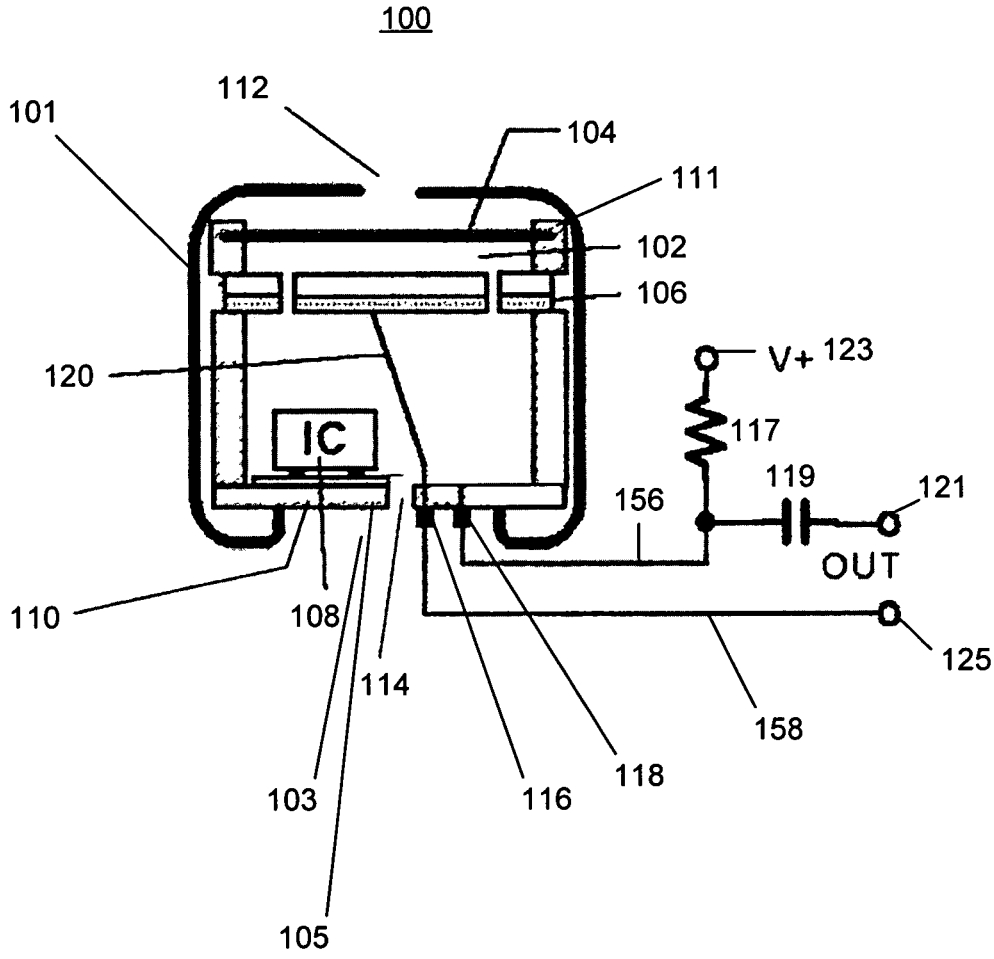
FIG. 1 (prior art)
FIG. 1 illustrates a diagram of a prior art noise canceling microphone.
Figure 2:
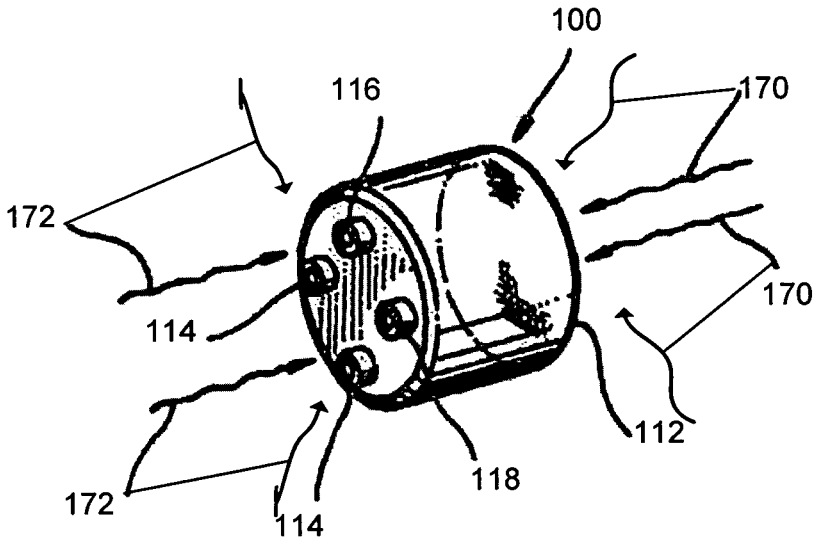
FIG. 2 (prior art)
FIG. 2 illustrates a perspective view of the prior art noise canceling microphone of FIG. 1.

Methods and apparatuses for a noise canceling microphone system are disclosed. The following description is presented to enable any person skilled in the art to make and use the invention. Descriptions of specific embodiments and applications are provided only as examples and various modifications will be readily apparent to those skilled in the art. The general principles defined herein may be applied to other embodiments and applications without departing from the spirit and scope of the invention. Thus, the present invention is to be accorded the widest scope encompassing numerous alternatives, modifications and equivalents consistent with the principles and features disclosed herein. For purpose of clarity, details relating to technical material that is known in the technical fields related to the invention have not been described in detail so as not to unnecessarily obscure the present invention.

Generally, this description describes a method and apparatus for a noise canceling microphone and noise canceling microphone boot system. While the present invention is not necessarily limited to electret condenser microphones, various aspects of the invention may be appreciated through a discussion of various examples using this context.

In one example, an electret condenser microphone is constructed so that the cancellation port is at a location remote from the microphone PCB containing the electrical lead terminals. For example, the cancellation port is located on the cylindrical surface of the microphone housing. In a further example of the invention, this electret condenser microphone is used with an elastomeric boot or boots with two acoustic cavities which are on the same side of the plane of the rear face of the microphone. As a result, the electrical lead terminals are not inside an acoustic cavity used by the microphone to receive acoustic signals and the electrical leads coupled to the terminals are not in an acoustic cavity. This eliminates the need for the electrical leads to pass through the surface of a microphone boot, thereby eliminating a source of acoustic leakage between the electrical lead and microphone boot. The acoustic seals are therefore of high quality and reliability.

In one example of the invention, a one piece boot with two acoustic cavities is utilized. As a result, the microphone acoustic seal does not depend on the relative motion between two boots, system performance does not rely on the assembly tolerance involving outer housing components, and the boot does not need to be under compression. Hence, a compression pad is not needed. In an additional example, two boots are used. The electrical leads do not pass through the surface of either of the two microphone boots.

Those of ordinary skill in the art will appreciate that the inventive concepts described herein apply equally well to microphones and microphone boots used in a variety of telecommunication devices. Although reference is made to a headset application, the microphone and microphone system may be used with handsets, cellular telephones, or other devices.

Figure 4:
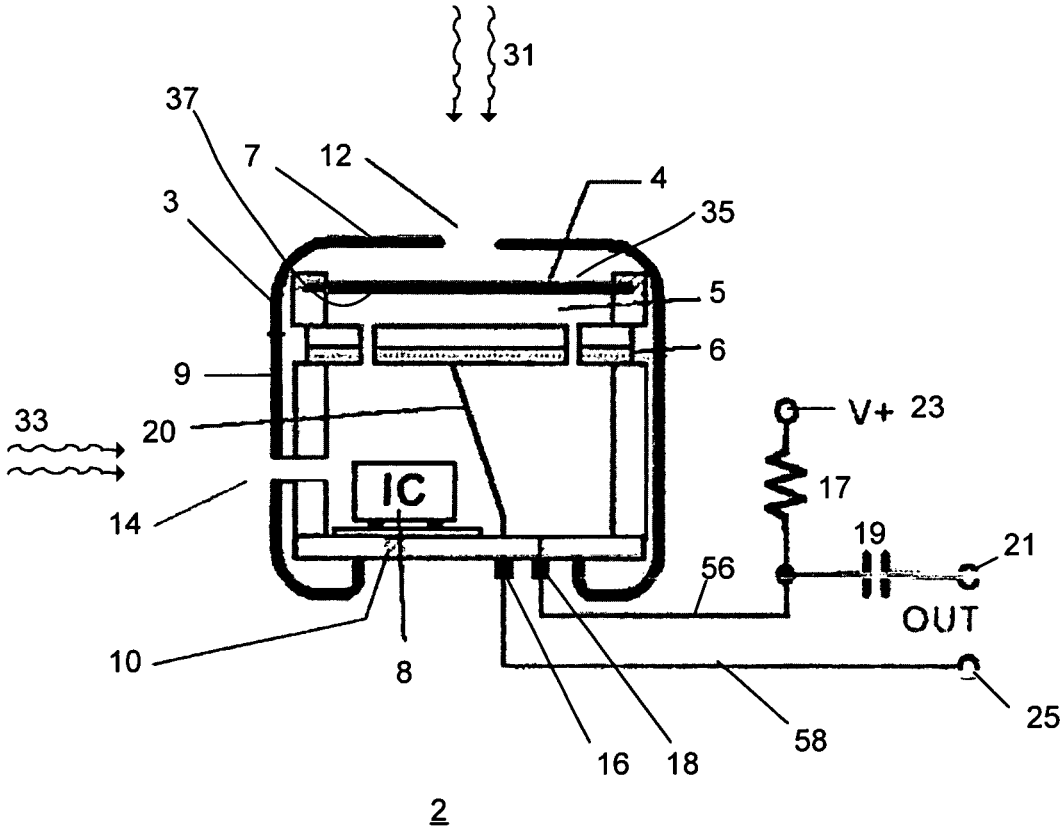
FIG. 4 illustrates a diagram of a noise canceling microphone in one example of the invention.

An example of the present invention comprises a unique noise-canceling, directional microphone 2 illustrated in FIG. 4. Microphone 2 is an electret type microphone comprised of a charged diaphragm 4 forming one plate of the capacitor and a backplate 6 forming the other plate. The charged diaphragm 4 is a charged metallized PTFE sheet that is stretched across a conductive spacer that rests onto the backplate 6. The charged diaphragm 4 and backplate 6 are disposed within a microphone housing 3. Microphone housing 3 is constructed, for example, of a metal can such as steel or aluminum. An air gap 5 is between diaphragm 4 and backplate 6. The microphone 2 has a primary port 12 and a cancellation port 14 for receiving acoustic input signals 31, 33. Microphone 2 has two electrical output terminals 16 and 18 for delivering an electrical signal representative of the difference in the acoustic input signals 31, 33. Electrical output terminals 16 and 18 are on the surface of PCB 10 to which a microphone electrical lead 56 and electrical lead 58 are attached.

In one example of the invention, the housing 3 has an open end with PCB 10 forming the face of the open end. PCB 10 has interior side facing the interior of housing 3 and an exterior side facing outwards. The exterior side of PCB 10 with terminals 16, 18 forms the external surface of the open end. In a further example, housing can 3 has an end surface replacing the open end and PCB 10 is disposed within the housing 3 adjacent the end surface of the housing 3.

In operation, sound enters the microphone through a primary port 12 and a cancellation port 14 in the housing 3, impinging on the diaphragm 4 from both sides, causing the diaphragm 4 to vibrate with the difference in sound pressure. In one example of the invention, primary port 12 is disposed in an end surface 7 of housing 3 opposite the open end at which PCB 10 is located. The movement of the charged plate formed by the diaphragm 4, with respect to the backplate 6 creates variations in capacitance. The resulting voltage change is detected from the backplate, amplified by the FET and coupled to signal processing circuitry. Although the housing of microphone 2 is illustrated as a cylindrical can in shape, the housing may be rectangular or other shapes in additional examples of the invention.

The pressure difference between the two acoustic input signals 31, 33 received at ports 12 and 14 is transduced into an electrical signal by diaphragm 4. Microphone 2 uses an integrated circuit (IC) 8 having a junction field effect transistor (JFET) disposed on PCB 10 to transform the very high impedance of the small capacitor formed by the electret microphone to a more usable lower value. Electrical terminal 16 is coupled to backplate 6 via a connector 20. PCB 10 is composed of copper plating and fiberglass reinforced phenolic or other suitable material typical in the art.

A first end of a resistor 17 is coupled to terminal 18. A filter capacitor 19 is coupled between terminal 18 and output terminal 21. The second end of resistor 17 is coupled to a bias voltage V+ 23. Terminal 16 is coupled to output terminal 25. Filter capacitor 19 is used to filter out the DC bias in the output of the microphone signal. One of ordinary skill in the art will recognize that other circuit architectures may be employed in additional examples of the invention.

Microphone 2 has a primary port 12 and a cancellation port 14. Neither primary port 12 nor cancellation port 14 are located on PCB 10 to which electrical leads 56, 58 are attached. This advantageously obviates the need for electrical leads 56, 58 to pass through a microphone boot. Primary port 12 is positioned on the microphone structure housing 3 to provide access to a first face 35 of diaphragm 4 whereas cancellation port 14 is positioned on the microphone structure housing 3 to provide access to a second face 37 of diaphragm 4. In an example of the invention, primary port 12 is located on an end surface 7 whereas cancellation port 14 is located on a side surface 9 disposed between the end surface and open end. However, in further examples the position of primary port 12 and cancellation port 14 on the housing may vary so long as each port provides access to a different side of diaphragm 4. For example, both primary port 12 and cancellation port 14 may be positioned on the side of housing 3.

In an embodiment of the invention, the microphone can housing is approximately 6 mm in diameter and typically 2.7 mm or 5 mm in height. The microphone PCB includes substantially planar conductive regions and electrical connections there from. The PCB may be multi-layer. Discrete circuit components are attached to the PCB layers by SMT. Conventional methods used to attach the leads include soldering the leads to conductive regions surrounding the PCB terminal holes. Typical electrical leads in the art are cylindrical and are composed of aluminum or copper and approximately 0.50 mm in diameter. Once assembled, the microphone device operates as a microphone for receiving speech signals in a telephonic device such as a cellular telephone or headset that provides wireless telephone communications for a user.

Figure 5:
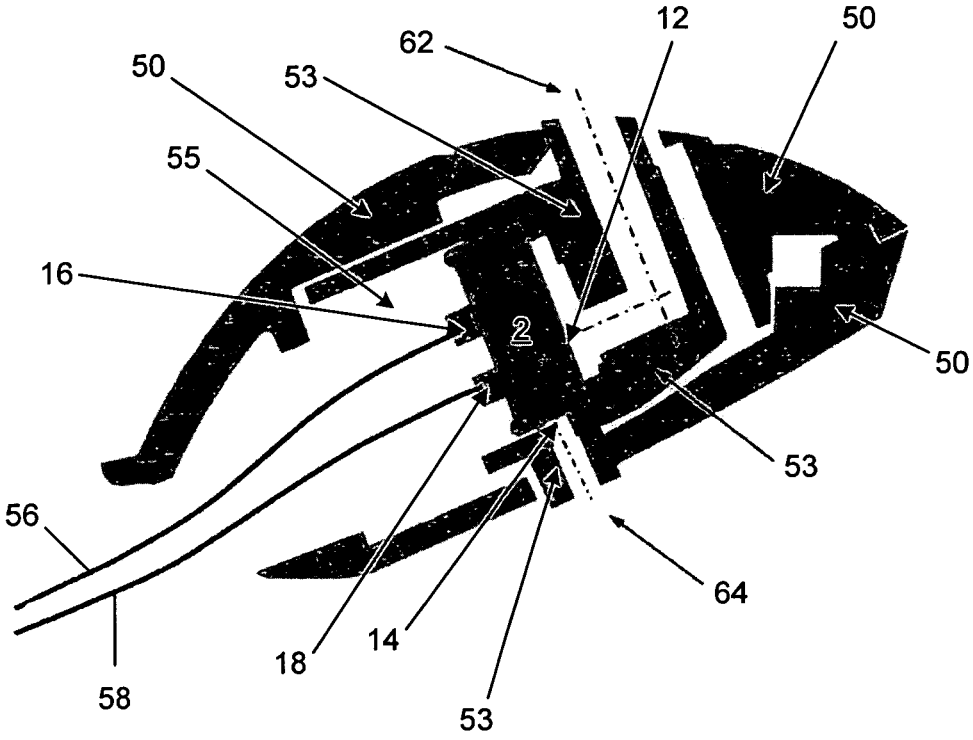
FIG. 5 illustrates a diagram of a noise canceling microphone in use with a headset boom in one example of the invention.

FIG. 5 illustrates microphone 2 in use with a headset boom 50. The microphone primary port 12 and cancellation port 14 are acoustically connected with corresponding headset ports 62, 64 via a single microphone boot 53. Boot 53 may contain acoustic cavities adjacent to each microphone port. PCB 10 forms the back surface of microphone housing 3 and contains the electrical terminals 16 and 18. Since PCB 10 does not contain cancellation port 14, microphone lead wires 56 and 58 do not pass through boot 53. This advantageously eliminates the need for an acoustic seal between lead wires 56 and 58 and a microphone boot. As illustrated below in reference to FIG. 7, both the boot acoustic cavities for the primary port 12 and cancellation port 14 are located on the same side of the microphone PCB 10. The use of a single boot 53 advantageously reduces the size of the microphone 2 and boot 53 combination, thereby allowing for a smaller microphone boom 50 or other housing. The use of a single boot 53 further eliminates the need for a compression pad which maintains a force in a two boot design between a front boot and rear boot to ensure an adequate acoustic seal. Assembly of the microphone and boot system is simplified, thereby reducing reject rates.

Figure 3:
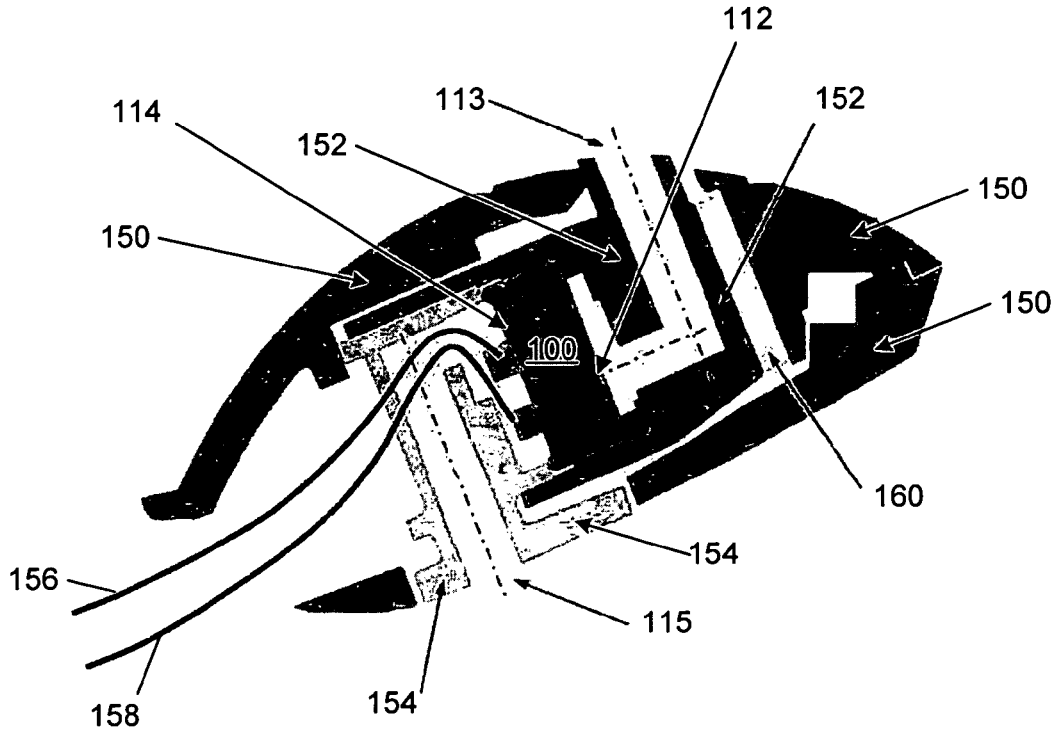
FIG. 3 (prior art)
FIG. 3 illustrates a diagram of a prior art noise canceling microphone in use with a headset boom.

The headset boom 50 is composed of molded plastic and includes a cavity 55 for housing microphone 2 and boot 53. In an example of the invention, microphone boot 53 forms a portion of the external surface of headset boom 50. The example design of FIG. 5 according to the present invention makes the volume behind the microphone, which, in the prior art design of FIG. 3 is occupied by the boot 154, available for other circuit components. The size and shape of this volume approximates a cylinder whose minimum diameter is the diameter of the microphone 100 and whose minimum height is the diameter of the acoustic port 115. Using an example of a 6 mm microphone diameter and 2 mm port diameter, the volume saved by the invention would be a minimum of 56 $mm^3$.

Figure 6:
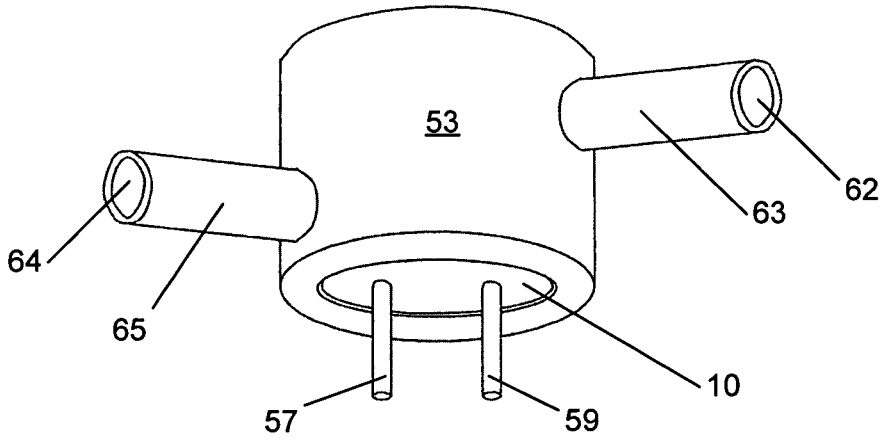
FIG. 6 illustrates a perspective view of a microphone boot in one example of the invention.
Figure 7:
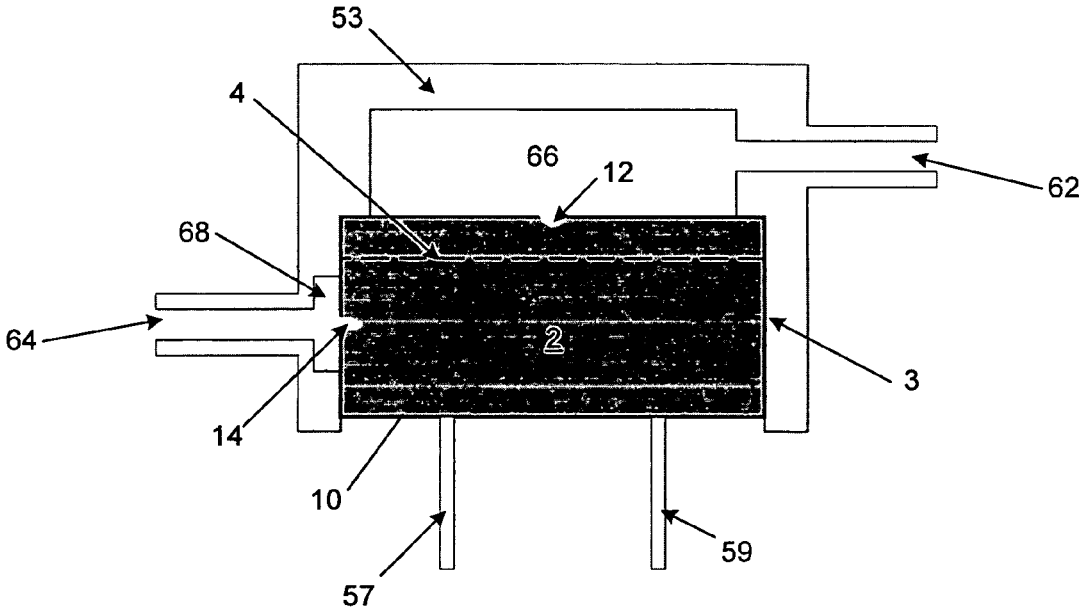
FIG. 7 illustrates a diagram of a boot in use with a microphone in one example of the invention.

FIG. 6 illustrates a perspective view of boot 53 in one example of the invention for use with microphone 2. FIG. 7 is a diagram of boot 53 used in conjunction with microphone 2. For example, boot 53 may be a single piece construction, in which case a compressive force is not required between two boots to maintain an adequate acoustic seal. The noise canceling microphone system of microphone 2 and boot 53 utilizes two acoustic cavities which are on the same side of the plane of the rear face of the microphone. For example, the rear face may be defined by PCB 10. As a result, the electrical lead terminals are not inside an acoustic cavity used by the microphone to receive acoustic signals and the electrical leads coupled to the terminals do not pass through an acoustic cavity. The electrical leads do not pass through the surface of a microphone boot, thereby eliminating a source of acoustic leakage between the headset port and microphone port.

Referring to FIG. 6 and FIG. 7, boot 53 includes a boot port 62 and a boot port 64. The microphone 2 is located within the boot 53 so that the microphone lead wire terminals 57, 59 do not need to pass through boot port 62 or boot port 64. Thus, acoustic seal between the lead wires 56, 58 and boot 53 is unnecessary and acoustic signals may be delivered through boot port 62 to microphone primary port 12 and through boot port 64 to microphone noise cancellation port 14 with minimal leakage.

The microphone boot 53 disposed within cavity 55 is preferably composed of a flexible material, such as urethane or the like. Microphone boot 53 is provided with a cavity region shaped to conform to a microphone 2 disposed in the cavity region. In one example, boot 53 is cylindrically shaped and includes round sleeves 63, 65 which form the boot ports 62, 64 protruding from the side curved surface. It should be noted, however, that the boot structure of the present invention is not so limited. Boot 53 includes an aperture through which the microphone lead wire terminals 57, 59 may extend when microphone 2 is inserted into boot 53. Boot port 62 leads to a first cavity 66 and is adapted to receive acoustic signals and pass them through microphone port 12. Boot port 64 leads to a second cavity 68 and is adapted to receive acoustic signals and pass them through cancellation port 14. Boot 53 may include additional components to aid in attaching the boot 53 to microphone 2 or within a headset boom or other device. The precise shape and components of boot 53 may vary.

Microphone 2 and boot 53 may be fitted together using a variety of means. A frictional fit between microphone 2 and boot 53 may be employed. For example, boot 53 may use one or more annular grooves to mate with corresponding annular ridges formed in the cylindrical sides of microphone 2.

Referring again to FIG. 7, the installation of the microphone 2 within boot 53 is shown. The microphone 2 is disposed within boot 53 with the front port 12 of the microphone 2 facing a first cavity 66 and the cancellation port 14 facing the second cavity 68 such that the microphone 2 is capable of receiving acoustic input signals though boot port 62 and boot port 64. In an example of the invention, the microphone 2 and boot 53 is aligned within a headset boot with boot port 62 directed towards the headset user mouth and the boot port 64 is directed away from the user mouth. In one example, the first cavity 66 and the second cavity 68 are on the same side of a plane defined by the printed circuit board 10 to which lead wire terminals 57, 59 are coupled.

Acoustic input signals from a user and noise sources pass through boot ports 62, 64 and cavities 66, 68; and are incident to the front port 12 and cancellation port 14, respectively, of microphone 2. The dimensions of the first cavity 66, second cavity 68, first port 62 and second port 64 may be selected to provide for an optimum acoustic response with the microphone 2 disposed within boot 53.

With reference to FIG. 6, a view of boot 53 is provided showing the microphone printed circuit board 10 and lead wire terminals 57, 59 extending there through. Lead wire terminals 57, 59 extend to connect the output of microphone 2 to an external electronic circuit. In addition to housing microphone 2, boot 53 provides structural support, boot port 62 and boot port 64 openings for receiving input audio signals at the external surface of the headset in which microphone 2 is used. When microphones with pin-type connectors are used, as shown in FIGS. 7 and 8, they are typically soldered directly onto the headset PCB.

Figure 8:
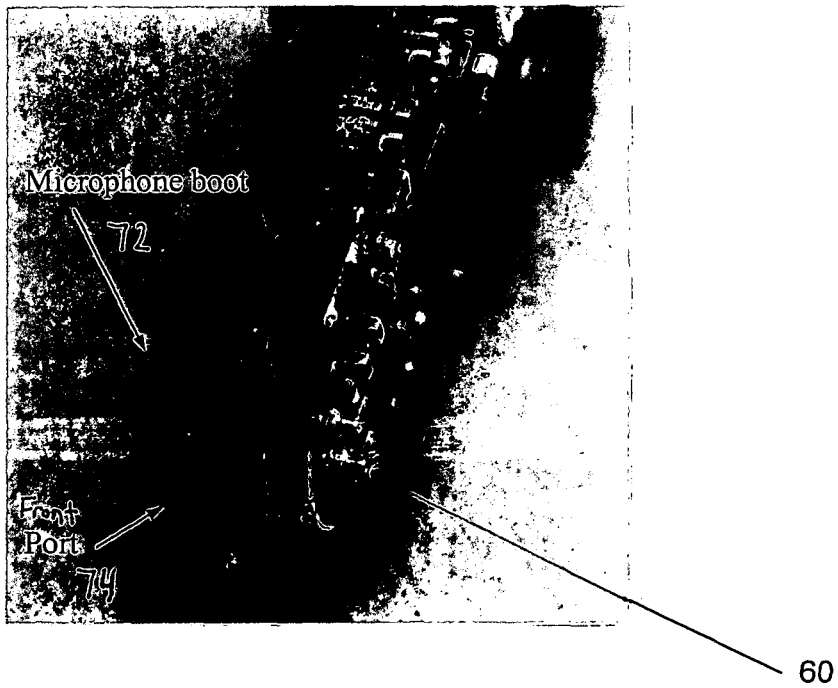
FIG. 8 (prior art)
FIG. 8 illustrates a prior art omnidirectional microphone attached to a headset printed circuit board.

FIG. 8 illustrates a prior art omni-directional microphone attached to a headset PCB 60. The back side of the headset PCB 60 is populated with circuit components and therefore not suitable to be sealed to a rear boot. As a result, only an omni-directional microphone with a front port 74 and a single microphone boot 72 may be used. Therefore, the headset assembly shown in FIG. 8 does not provide noise cancellation.

Figure 9:
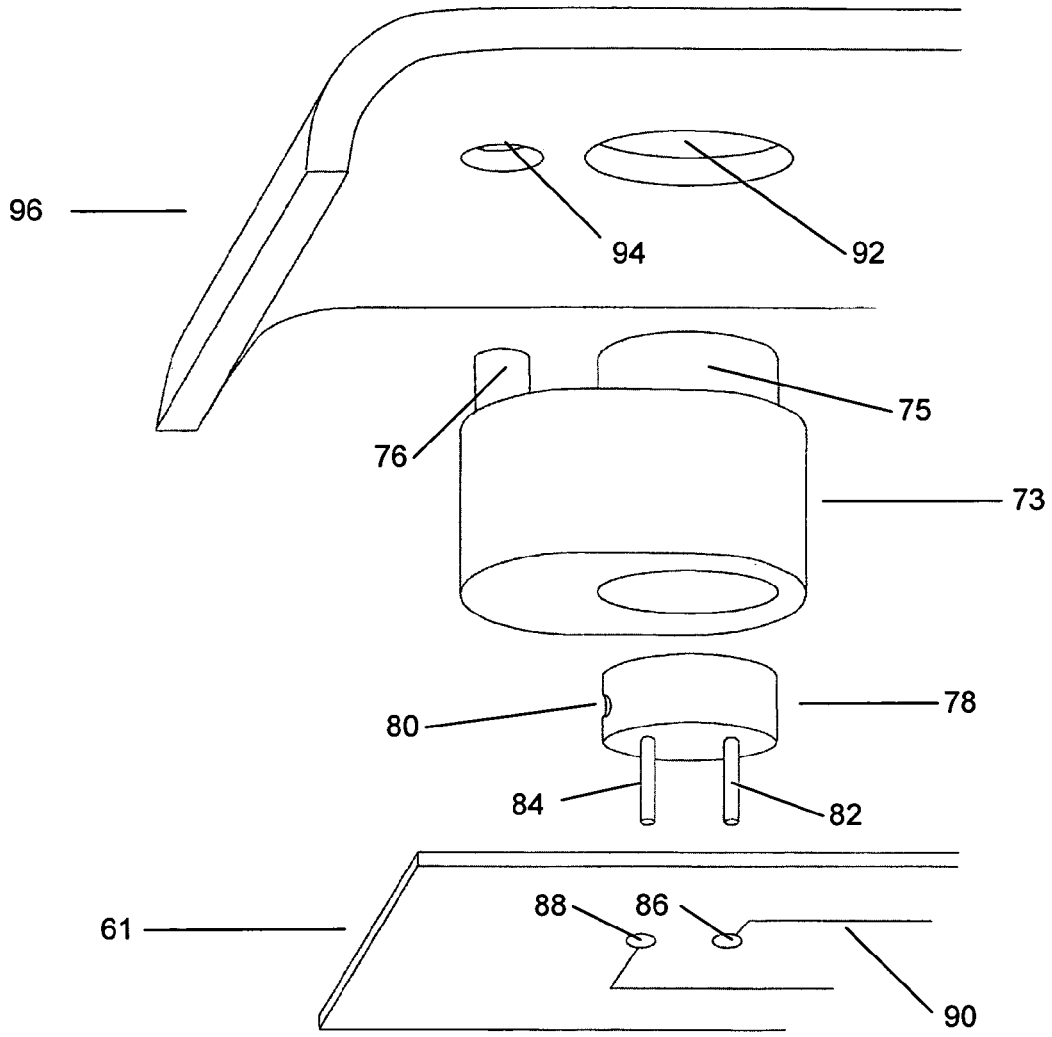
FIG. 9 illustrates a disassembled microphone and headset printed circuit board assembly in one example of the invention.

FIG. 9 illustrates a disassembled perspective view of a noise canceling microphone assembly used with a headset boom in an example of the invention. A microphone 78 with a cancellation port 80 is disposed within microphone boot 73 and mounted on headset PCB 61 using terminals 82, 84 and terminal mounts 86, 88 on headset PCB 61. Terminal mounts 86, 88 are connected to PCB circuitry 90 for output and processing of the microphone signal. Since cancellation port 80 is not on the same surface as the microphone PCB to which terminals 82, 84 are mounted, microphone 78 disposed within single piece microphone boot 73 can be mounted on headset PCB 61 without the need for an opening in headset PCB 61 to provide access to cancellation port 80. This advantageously allows headset PCB 61 to be fully populated with circuit components (not shown) and eliminates the need for the headset PCB 61 to be acoustically sealed to the microphone 78, the one-piece boot 73 or a rear boot. The one-piece microphone boot 73 has a boot primary port 75 and a boot cancellation port 76 leading to a corresponding primary port on microphone 78 (not shown) and microphone cancellation port 80. Boot primary port 75 and boot cancellation port 76 align with aperture 92 and aperture 94 respectively in headset housing 96.

Figure 10:
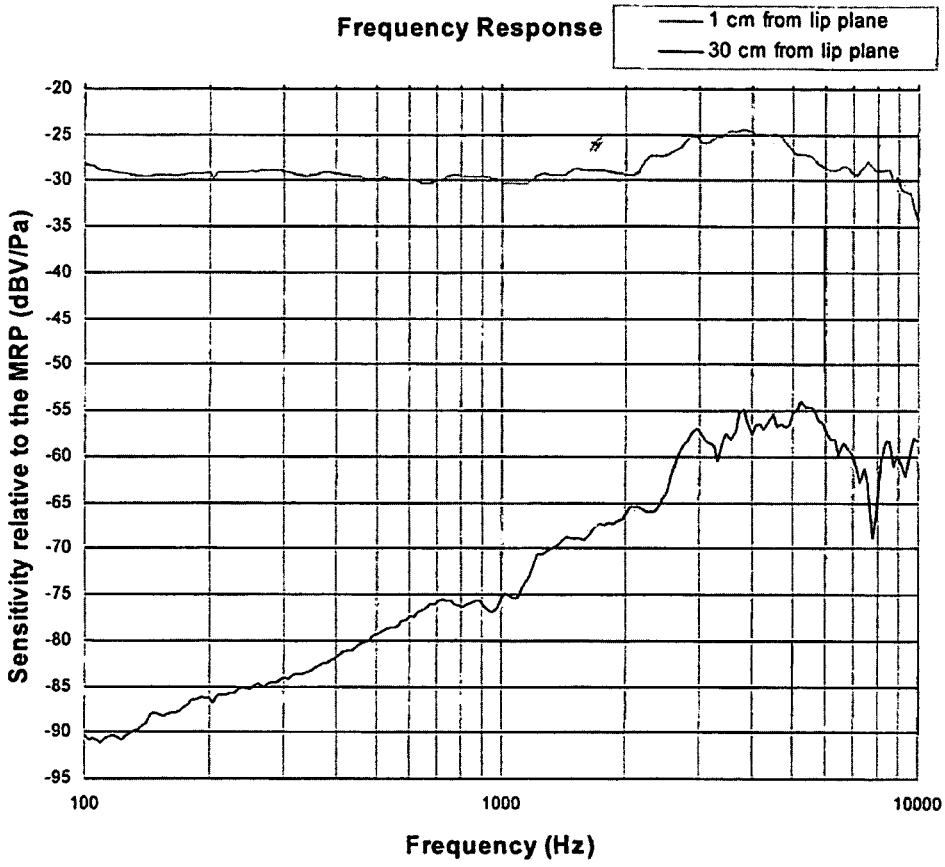
FIG. 10 illustrates the near-field and far-field frequency test response of a microphone in one example of the invention.

The sub-assembly of the microphone and boot is a fully functional noise canceling unit that may be tested before being assembled into the rest of the headset. FIG. 10 illustrates a near-field (1 cm from the lip plane) and far-field (30 cm from the lip plane) frequency response of a microphone constructed as described herein in one example of the invention. The combination of high-pass far field response and flat near field response is evidence of the proximity effect, a phenomenon exhibited only by noise canceling (i.e., gradient) microphones.

The various examples described above are provided by way of illustration only and should not be construed to limit the invention. For example, although use of a microphone and microphone system placed in a headset boom is described, the systems and methods described herein can also be applied with other communication devices.

Based on the above discussion and illustrations, those skilled in the art will readily recognize that various modifications and changes may be made to the present invention without strictly following the exemplary embodiments and applications illustrated and described herein. Such changes may include, but are not necessarily limited to: number of microphone boots used with the microphone; shape of microphone housing; location of primary port and secondary port on the microphone housing; shape of microphone boot or boots; type of terminals or leads to perform electrical connections; signal processing circuitry. Such modifications and changes do not depart from the true spirit and scope of the present invention that is set forth in the following claims.

Thus, the scope of the invention is intended to be defined only in terms of the following claims as may be amended, with each claim being expressly incorporated into this Description of Specific Embodiments as an embodiment of the invention.

What is claimed is:

1. A noise canceling microphone system comprising:

a noise canceling microphone comprising:

a housing can;

a printed circuit board that comprises an interior side facing an interior of the housing can and an exterior side facing outwards;

a first electrical terminal disposed on the exterior side of the printed circuit board;

a second electrical terminal disposed on the exterior side of the printed circuit board;

a diaphragm disposed within the housing can, wherein the diaphragm comprises a diaphragm first face and a diaphragm second face;

a first microphone port disposed in the housing can acoustically coupled to the diaphragm first face; and a second microphone port disposed in the housing can acoustically coupled to the diaphragm second face; and a microphone boot disposed about the noise canceling microphone comprising:

a first boot port acoustically coupled to the first microphone port; and a second boot port acoustically coupled to the second microphone port, wherein the first boot port, the second boot port, the first microphone port and the second microphone port are on the same side of a plane defined by the printed circuit board;

and wherein the first electrical terminal and the second electrical terminal are located outside the first boot port and outside the second boot port.

2. The noise canceling microphone system of claim 1, wherein a first cavity providing access to the first microphone port and a second cavity providing access to the second microphone port are on the same side of a plane defined by the printed circuit board.

3. The noise canceling microphone system of claim 1, further comprising a first electrical lead attached to the first electrical terminal and a second electrical lead attached to the second electrical terminal.

4. The noise canceling microphone system of claim 3, wherein the microphone boot further comprises a third aperture leading to the printed circuit board, wherein the first electrical lead and the second electrical lead pass through the third aperture.

5. The noise canceling microphone system of claim 1, wherein the microphone boot comprises a urethane material.

6. The noise canceling microphone system of claim 1, further comprising a headset printed circuit board, wherein the first electrical terminal and the second electrical terminal comprise pin-type connectors direct mounted to the headset printed circuit board.

7. The noise canceling microphone system of claim 1, wherein the microphone boot is a single-piece construction.

8. A noise canceling microphone system comprising:

a noise canceling microphone comprising:

a housing, wherein a printed circuit board forms a first surface of the housing;

a first electrical terminal and a second electrical terminal disposed on an exterior side of the printed circuit board;

a diaphragm disposed within the housing, wherein the diaphragm comprises a diaphragm first face and a diaphragm second face;

a first microphone port disposed in the housing remote from the first surface acoustically coupled to the diaphragm first face; and a second microphone port disposed in the housing remote from the first surface acoustically coupled to the diaphragm second face; and a microphone boot disposed about the noise canceling microphone comprising:

a first boot port and first cavity leading to the first microphone port; and a second boot port and second cavity leading to the second microphone port, wherein the first cavity and the second cavity are on the same side of a plane defined by the printed circuit board.

9. The noise canceling microphone system of claim 8, wherein the microphone boot is a single-piece construction.

10. The noise canceling microphone system of claim 8, wherein the microphone boot further comprises an aperture leading to the printed circuit board, wherein the aperture provides access to the first electrical terminal and the second electrical terminal.

11. The noise canceling microphone system of claim 10, further comprising a first electrical lead attached to the first electrical terminal and a second electrical lead attached to the second electrical terminal, wherein the first electrical lead and the second electrical lead acoustically seal the aperture as they pass through it.

12. The noise canceling microphone system of claim 8, wherein the first electrical terminal and the second electrical terminal are located outside the first boot port and first cavity and outside the second boot port and second cavity.

13. The noise canceling microphone system of claim 8, wherein the microphone boot comprises a urethane material.

14. The noise canceling microphone system of claim 8, further comprising a headset printed circuit board, wherein the first electrical terminal and the second electrical terminal comprise pin-type connectors direct mounted to the headset printed circuit board.

* * * * *